United States Patent [19]

Neil et al.

[11] Patent Number: 4,750,702

[45] Date of Patent: Jun. 14, 1988

[54] TREE STAND

[76] Inventors: Gordon J. Neil, 28651 Kissing Rock Road, Box 72, Wedderburn, Oreg. 97491; Marlin L. Neil, Box 1247; Michael L. Neil, Box 857, both of Gold Beach, Oreg. 97444

[21] Appl. No.: 889,269

[22] Filed: Jul. 25, 1986

[51] Int. Cl.[4] ..... F16M 13/00

[52] U.S. Cl. ..... 248/523; 248/529

[58] Field of Search ..... 248/511, 519, 523, 529, 248/150, 165, 346, 524, 527; 47/40.5

[56] References Cited

U.S. PATENT DOCUMENTS

| | | | |
|---|---|---|---|
| 806,402 | 12/1905 | Donnelly | 248/529 |
| 1,298,380 | 3/1919 | Owen | 248/523 |
| 1,721,980 | 7/1929 | Wardell | 47/40.5 |
| 1,997,870 | 4/1935 | Merrill | 248/529 |
| 2,430,840 | 11/1947 | Westfall | 248/529 |
| 2,655,331 | 10/1953 | Merritt | 248/523 |
| 2,730,321 | 1/1956 | Dutton | 248/529 |
| 2,855,168 | 10/1958 | Vigna | 248/529 |
| 2,893,668 | 7/1959 | Applegate | 248/523 |
| 2,997,264 | 8/1961 | Zelenitz | 248/523 |
| 3,033,505 | 5/1962 | Brown | 47/40.5 |
| 3,142,464 | 7/1964 | Zelenitz | 47/40.5 |
| 3,143,324 | 8/1964 | Kappelman | 47/40.5 |
| 3,272,462 | 9/1966 | Apple | 248/523 |
| 3,350,043 | 10/1967 | Apple | 248/523 |
| 3,820,749 | 6/1974 | Leonard | 248/523 |
| 4,313,588 | 2/1982 | Sjostrand | 248/524 |
| 4,585,201 | 4/1986 | Pursell | 248/523 |

FOREIGN PATENT DOCUMENTS

| | | | |
|---|---|---|---|
| 267282 | 10/1963 | Australia | 248/529 |

*Primary Examiner*—J. Franklin Foss
*Assistant Examiner*—Robert A. Olson
*Attorney, Agent, or Firm*—Klarquist, Sparkman, Campbell, Leigh & Whinston

[57] ABSTRACT

The invention comprises an improved Christmas tree stand having a central support hub which has a shaft embedded therein which extends upwardly from an upper portion of the hub. The shaft is adapted to penetrate the base of a tree trunk for supporting the trunk on the hub. At least three leg members extend outwardly from the hub for supporting the hub and the tree engaged by the shaft. A liquid retaining reservoir is provided a top the central support hub for retaining water for nourishing a tree supported by the shaft.

2 Claims, 1 Drawing Sheet

18
40
22
20
44
26
14
16
12
10
34
28
24
36

100

24
26
120
14
122
16
44
22
12
28

26
10
40
36
20
34
24
14
12
3
3
44
22
41
38
28

18
41
42
14
39
20
40
44
44a
16
44b
30
12
34
43
24
29
32
26
10

TREE STAND

BACKGROUND OF THE INVENTION

The present invention relates to tree holders and more particularly to a stand for a Christmas tree and the like.

There are many types of stands for supporting Christmas trees. However, most have drawbacks in that they are either too flimsy to withstand repeated use, too bulky for easy shipment and storage, or too complex and therefore expensive. One such stand, as shown in U.S. Pat. No. 2,655,331 to Merritt, has a pair of crossed support members which collapse to a parallel relationship when not supporting a tree. A screw extends through the center of the support members and threads into the base of a tree trunk. A locking pin locks the support members in crossed or parallel relationship. Although simple, such a stand provides no means for watering the tree and has several separable small parts which are easily lost.

Other stands incorporate water pans for nourishing the tree. One typical such stand includes a sheet metal water pan having three or four flimsy sheet metal support legs which extend through an upper rim of the pan to a ring centered above the pan. Bolts threaded through the legs and ring and are forced into sides of a tree trunk extending through the ring and resting on the bottom of the pan. Such a stand is unstable, easily bent out of shape, and difficult to assemble and use so that the tree is supported vertically.

Other tree stands such as shown in U.S. Pat. Nos. 3,350,043 to Apple, 3,272,462 to Apple, and 2,893,668 to Applegate, disclose essentially three-legged tree stands. The legs radiate from a central member from which a screw extends upwardly through a water pan into the base of a tree trunk. Although such stands can be at least partially disassembled or collapsed, they cannot be collapsed or broken down into a compact package for shipment or storage and are, in general, large, complex, and costly to manufacture.

Another simple tree stand includes three legs radiating outwardly and downwardly from a central lag screw for threading into the base of a tree trunk. The legs are welded to the screw. Such stand has no water pan and is bulky, making it difficult and expensive to ship and store.

Accordingly, there is a need for a tree stand which provides a stable support for a tree and yet is of simple, rugged, inexpensive contruction, and can be shipped and stored in a compact package. These are the primary objectives of the invention.

Another object is to provide a tree stand as aforesaid that is easy to assemble and use.

Another object is to provide a stand as aforesaid that includes a water pan.

SUMMARY OF THE INVENTION

In the present invention, the foregoing objectives are met by providing the tree stand with a central support hub having a shaft embedded therein which extends upwardly from an upper portion of the hub. The shaft is adapted to penetrate the base of a tree trunk for supporting the trunk on the hub. At least three removable leg members radiate from bores in the hub for supporting the hub and the tree engaged by the shaft. A water pan may be provided atop the hub for retaining water to nourish a tree supported by the shaft. In such case, a water seal coacting between the hub and pan or pan and tree, or both, prevents water leakage from the pan when the shaft pentrates the pan.

These and other objects, features and advantages of the present invention will be more readily understood from the following detailed description which proceeds with reference to the accompanying drawings.

DETAILED DESCRIPTION OF PREFERRED EMBODIMENTS

Figure 1:
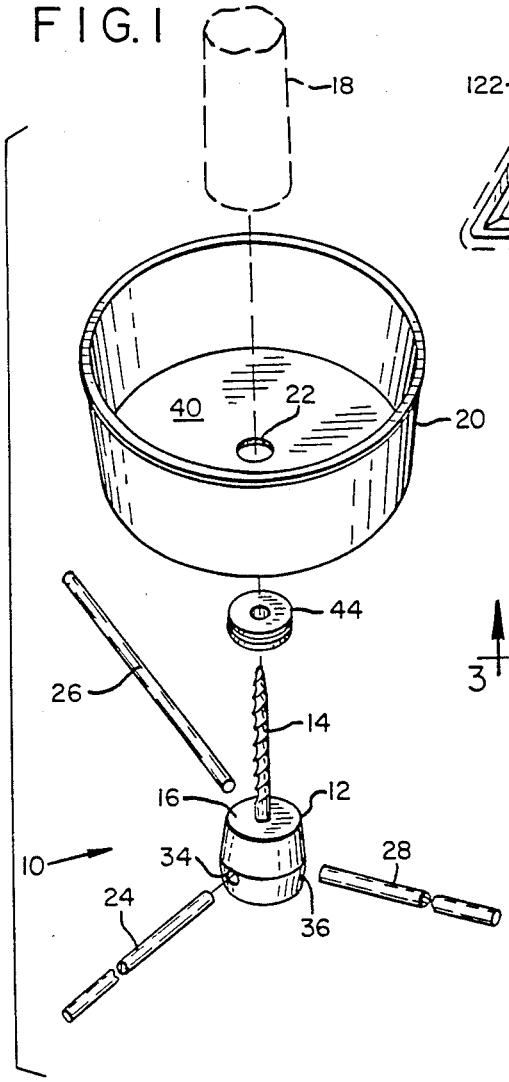
FIG. 1 is an exploded perspective view of one embodiment of a tree stand in accordance with the invention.
Figure 2:
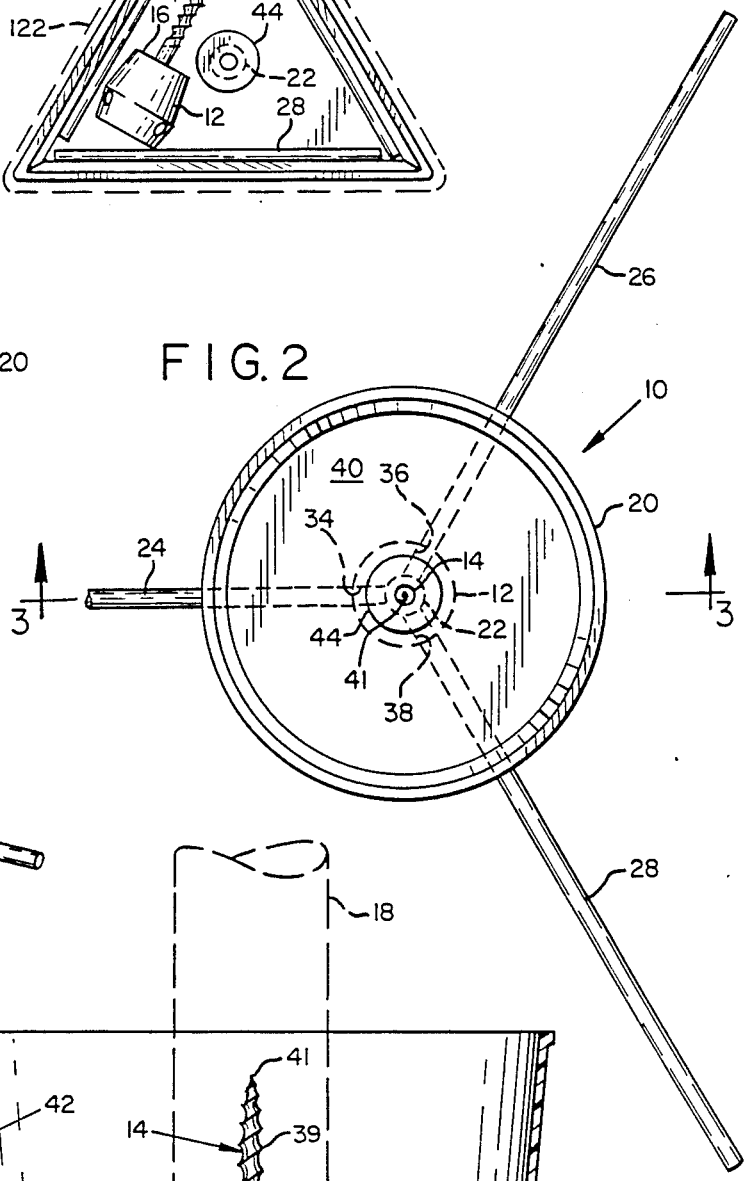
FIG. 2 is a top view of the assembled FIG. 1 embodiment.
Figure 3:
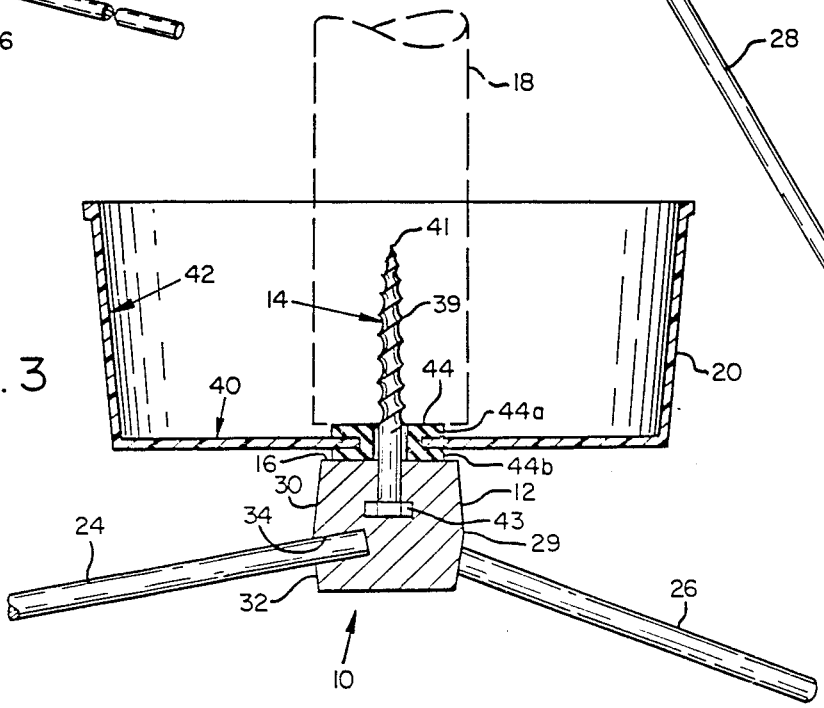
FIG. 3 is a sectional view taken along line 3—3 of FIG. 2.

FIG. 1–3 Embodiment

Referring to FIGS. 1–3, a stand 10 for a Christmas tree includes a relatively massive central support hub 12 having a shaft 14 embedded therein. Shaft 14 extends upwardly from an upper surface 16 of hub 12 for penetrating the base of a tree trunk 18. A water reservoir or pan 20 can also be included, with shaft 14 extending upwardly through a hole 22 in the center of the bottom of the pan. Three separate leg members 24, 26, 28 are slidably received by bores 34,36,38 in hub 12 and radiate outwardly and downwardly therefrom for supporting the hub and tree 18 engaged by shaft 14.

Support hub 12 comprises a solid generally cylindrical body preferably of cast aluminum or other metal, although it might also be made of plastic. Body 12 is widest at a lower intermediate waist portion 29 from which an upper side wall 30 tapers inwardly, and a lower side wall 32 tapers inwardly. Three bores 34, 36, 38 extend at an upward angle into lower side wall 32 toward the central axis of the hub. As shown, the bores are equally angled at an inclination of about ten (10) degrees to the horizontal and all penetrate the hub at the same level and at locations equally spaced about the hub. This ensures that legs 24, 26, 28 may all be of the same length and will provide a level tripod support for the hub with the axis of the hub extending generally vertically with the legs resting on a generally horizontal support surface.

Legs 24, 26, 28 comprise three smooth rods of equal length, preferably of steel although they can also be made of other metals or plastic. They are sized to slip easily into hub bores 34, 36, 38 but with minimum play to minimize deflection of the legs when in use.

Shaft 14 comprises a lag screw having a threaded shank portion 39 terminating in an upper point 41 and enlarged lower head 43. The lag screw is permanently joined to hub 12 by having its lower head portion 43 embedded in the hub when the hub is cast. Thus hub 12 is essentially a cylinder with a threaded shaft projecting from one end and equally spaced radially inclined bores penetrating its lower sidewall.

Referring more particularly to FIG. 3, pan 20 has a bottom wall 40 and frusto-conical side wall 42. HoIe 22 is provided centrally through bottom wall 40 to provide access for shaft 14 to the interior of the pan and a tree trunk 18 therein. A water sealing means in the form of a resilient annular grommet 44 grips the bottom 40 of the pan surrounding hole 22 to prevent water from leaking from the pan when shaft 14 penetrates the hole and the base of trunk 18 within the pan. Grommet 44 effects its seal only when shaft 14 is threaded fully into the base of tree trunk 18 to squeeze the upper part 44*a* of the grommet between the bottom of the trunk 18 and the inside bottom of the pan and to squeeze the lower part 44*b* of the grommet between the top 16 of the hub and the outside bottom of the pan. Thus both upper and lower portions of the grommet provide seals to ensure that no water leaks from the pan when shaft 14 is fully threaded into a tree trunk.

FIG. 4 Embodiment

Figure 4:
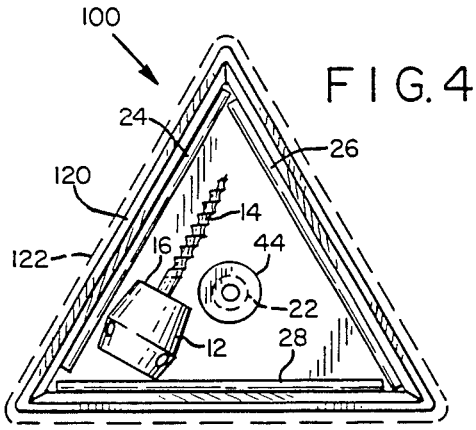
FIG. 4 is a top view of a second embodiment of the tree stand shown disassembled and configured for shipping or storage.

Referring to FIG. 4, a second embodiment of the invention is shown wherein the reservoir or pan 120 is equilateral triangular in shape. The sides of the triangular pan are of sufficient length to retain each of the leg members and hub therein for shipping and storage. The pan can also be provided with a triangular lid 122 so that the pan serves as the shipping and storage container for the remaining portions of the disassembled stand. Other alternate shapes of the reservoir could be employed which have at least one dimension long enough to retain the leg members and another dimension wide enough to retain the hub. The only difference between the FIG. 1 and FIG. 4 embodiments is the size and shape of their respective pans. Therefore all corresponding parts of each embodiment, except the pan, have the same reference numbers.

Operation

To use the stand, the user inserts shaft 14 through grommet 44 and into the interior of pan 20. The point 41 of the shaft is started into the bottom of the tree trunk extending into the pan from its open top, with or without the aid of a pilot hole in the trunk.

One of rods 24, 26, or 28 is then inserted into a bore 34, 36 or 38 of hub 12 and used as a handle to rotate the hub and thread the shaft into the trunk of tree 18. Threading continues until the base of tree 18 bears snugly against upper grommet portion 44*a* and the top 16 of hub 12 bears snugly against lower grommet portion 44*b*, thereby creating a fluid tight seal at hole 22 to prevent water from leaking from the pan. The resulting tripod with the tree attached is lifted to an upright position with the leg rods resting on a flat surface.3 Should the tree not be standing exactly straight upright, one or two of the legs can be shimmed to shift the tree to a vertical position.

When removing the stand from the tree, the reverse procedure is followed. Two of the three rods are pulled from the hub, and the third rod is used as a handle to turn the hub in a counterclockwise direction to unthread the shaft from the tree. Of course, the water is first removed from the pan. When the shaft is separated from the tree, the remaining rod is pulled from the hub, the shaft is pulled from the pan, and the hub-shaft and legs are stored in the pan.

The tree stand can be manufactured in different sizes to support trees of different sizes. When the diameter of the shaft is large in comparison to the diameter of the tree trunk, a hose clamp can be tightly secured around the base of the trunk to prevent the trunk from splitting when the shaft is threaded or driven into the base. A pilot hole can also be bored into the base of a small trunk to reduce the chances of the trunk splitting when the shaft is driven in.

Although the invention is most effective with the hub provided with a threaded shaft, the hub could be provided with an unthreaded spike. However, the water seal at the pan hole could be less effective if a spike is used. Conceivably a smooth cylindrical shaft with a blunt free end could be provided with the hub if a pilot hole is bored in the tree trunk. In any case the hub-shaft portion of the stand is a rigid, one-piece inseparable unit.

Although the leg rods and hub bores could be threaded together, this is not necessary, would increase the cost of manufacture, might require tools to assemble and disassemble the stand, and could create thread-stripping problems. The use of smooth rods and bores facilitates rapid assembly and disassembly without tools and helps keep manufacturing costs low.

Having illustrated and described the principles of my invention with reference to a preferred embodiment and one alternative, it should be apparent to those persons skilled in the art that such invention may be modified in arrangement and detail without departing from such principles. I claim as my invention such embodiments and all modifications and variations thereof that come within the true spirit and scope of the following claims.

I claim:

1. A stand for a Christmas tree and the like comprising:

a central substantially cylindrical support hub comprising a solid massive body having a height at least substantially as great as its width, a screw-threaded shaft having an enlarged head embedded in said solid body with said threaded shaft extending upwardly from an upper end of said body and tapering to a pointed shaft upper end, means defining at least three untapped bores of substantially equal length extending into sidewall portions of said solid body at substantially equally circumferentially spaced locations about said body and at substantially equal shallow angles of inclination from an underlying hub support surface and substantially equidistant from the upper end of said body, said bores extending toward the central vertical axis of said solid body, a plurality of elongate rod-like legs corresponding in number to the number of said bores and sized to be slidably and removably received in said bores to radiate outwardly therefrom at an angle of inclination corresponding substantially to the angle of inclination of said bores for supporting said hub and an attached tree in an upright position on the underlying support surface when said threaded shaft is threaded upwardly into the base of the attached tree.

2. The stand of claim 1 including a water pan having a bottom with a centrally located hole therethrough for receiving said threaded shaft such that in use the shaft extends upwardly from the hub into the pan, and sealing means for preventing water leakage through the hole when the shaft penetrates the hole and is threaded into the base of a tree trunk within the pan.

* * * * *